US006718994B2

(12) United States Patent
Lewis

(10) Patent No.: US 6,718,994 B2
(45) Date of Patent: Apr. 13, 2004

(54) COVER FOR CRUTCH UNDERARM SUPPORT

(76) Inventor: Linda S. Lewis, 303 Locust Forge Dr., Lebanon, OH (US) 45036

( * ) Notice: Subject to any disclaimer, the term of this patent is extended or adjusted under 35 U.S.C. 154(b) by 0 days.

(21) Appl. No.: 09/923,214

(22) Filed: Aug. 6, 2001

(65) Prior Publication Data

US 2003/0024558 A1 Feb. 6, 2003

(51) Int. Cl.[7] ..... A61H 3/02
(52) U.S. Cl. ..... 135/73
(58) Field of Search ..... 135/65, 71, 72, 135/73, 68; D3/8, 10; 297/227, 220, 228.11, 224

(56) References Cited

U.S. PATENT DOCUMENTS

| | | | | | |
|---|---|---|---|---|---|
| 1,499,458 | A | * | 7/1924 | Hughes | 135/69 |
| 3,295,577 | A | * | 1/1967 | Danielson | 108/90 |
| 4,711,261 | A | | 12/1987 | Rosenberg | |
| 5,078,640 | A | | 1/1992 | Berman | |
| 5,101,846 | A | | 4/1992 | Greatwood | |
| 5,333,921 | A | * | 8/1994 | Dinsmoor, III | 297/219.1 |
| 5,340,005 | A | * | 8/1994 | Woods et al. | 135/66 |
| 5,907,877 | A | * | 6/1999 | Allgood | 150/154 |
| 6,126,240 | A | * | 10/2000 | Tse | 297/181 |
| 6,145,508 | A | * | 11/2000 | Seip, Jr. | 128/845 |
| 6,212,801 | B1 | * | 4/2001 | Kellogg et al. | 38/140 |
| 6,457,423 | B1 | * | 10/2002 | Gordon | 108/90 |
| 6,578,914 | B2 | * | 6/2003 | Artsvelyan | 297/219.1 |

FOREIGN PATENT DOCUMENTS

| | | | |
|---|---|---|---|
| GB | 2247839 | * | 3/1992 |

* cited by examiner

*Primary Examiner*—Janet M. Wilkens
(74) *Attorney, Agent, or Firm*—Wood, Herron & Evans, L.L.P.

(57) ABSTRACT

A covering for the underarm support of a medical crutch that provides extra padding and comfort to the patient using the crutch. The crutch underarm support covering consists of a flexible sheet material, e.g., a fabric, that forms the outer and inner faces of the cover having a peripheral edge. The complete peripheral edge of the pad is expandable and recoverable and thereby facilitates both fastening the cover to the underarm support of a crutch as well as reversing the pad faces. Preferably, a cushioning element is disposed in a pocket between the inner and outer faces. The complete peripheral edge of the pad is made expandable and recoverable by the insertion of either an elastic or non-elastic material capable of gathering the edge.

27 Claims, 2 Drawing Sheets

COVER FOR CRUTCH UNDERARM SUPPORT

FIELD OF THE INVENTION

This invention relates to a covering for the underarm support of a crutch and methods for making such a covering.

BACKGROUND OF THE INVENTION

This invention pertains to a covering for the underarm support of a medical crutch that provides extra padding and comfort to the underarm area of the patient using the crutch.

Known crutch pads contain some type of covering for the underarm support of a medical crutch that incorporates some degree of padding. U.S. Pat. Nos. 4,711,261, 5,078,640, and 5,101,846 disclose a flocked or other cushioning material, or a compressible filler, in an enveloping configuration that can be secured to the underarm support of a crutch.

U.S. Pat. No. 4,711,261, issued to Rosenburg Dec. 8, 1987, describes a cushioning covering for a load bearing member of a crutch. The '261 patent discloses a cushioned fabric cover that is formed in the basic shape of the existing underarm support cover. The cushioning covering of the '261 patent is slipped over the underarm support and is secured with Velcro straps that run under the existing support.

U.S. Pat. No. 5,101,846, issued to Greatwood Apr. 7, 1992, discloses a covered crutch pad that is constructed of a flocked or other cushioning material. The crutch pad is composed of an outer envelope constructed from a cushioning material. Another inner envelope is fitted inside the outer envelope and serves to secure the covering to the existing underarm support as well as provide cushioning. This cover provides extra padding to the underarm area as well as the interior of the arm and side of the torso.

U.S. Pat. No. 5,078,640, issued to Berman Jan. 7, 1992, relates to a plaything or plush toy that is usable as a crutch pad. The '640 patent consists of a plush outer surface constructed to resemble an animal or similar object of interest. The inside of the object is filled with a compressible filler. The plush toy can be disposed over the top of the existing underarm support member and securely fastened, as in the '261 patent, with a Velcro strap.

In view of the known crutch pads as represented by the above patents, further improvements are needed.

SUMMARY OF THE INVENTION

This invention pertains to a covering for the underarm support of a medical crutch that provides extra padding and comfort to the patient using the crutch and other desirable benefits.

In one form of the invention, the crutch underarm support covering consists of a flexible sheet material, e.g., a fabric, that forms the outer and inner faces of the cover and also a peripheral edge. The complete peripheral edge is expandable and recoverable. This facilitates securely fastening the pad to the underarm support of a medical crutch. This feature also facilitates the easy removal of the pad from the underarm support of the crutch.

In another form of this invention, the crutch underarm support covering consists of a flexible sheet material, e.g., a fabric, that forms the outer and inner faces of the cover and also a peripheral edge. A cushioning element is disposed between these faces. The complete peripheral edge is expandable and recoverable which facilitates securely fastening and removing the crutch underarm cover to the underarm support of a medical crutch. The expandability and recoverability of the complete peripheral edge also permits the inner and outer faces of the cover to be reversed, thereby becoming the new outer and inner faces, respectively.

This invention also relates to a method for making the padded crutch covers. The crutch pad is made by joining one or two sheets of flexible material. The material is joined in such a manner so as to create a pocket. An elongated element which facilitates the complete peripheral edge being expandable and recoverable is adapted to be secured along the periphery of the pocket. The elongated element may be a cord or an elastic band. The pocket is filled with a cushioning material and closed, leaving the ends of the elongated element exposed for manipulation.

When the peripheral edge is gathered, the pad becomes mushroom-like with a top outer face and a bottom inner face that forms a cavity to receive the underarm crutch support. The placement of the elongated element facilitates the reversal of the top outer face and the bottom inner face. The pad is placed on the crutch so that the underarm support of the crutch is adjacent the bottom inner face of the pocket. The complete peripheral edge of the pad is expandable to accommodate the introduction of the crutch support. After the crutch support has been inserted, either a gathering cord or elastic is used to securely fasten the pad to the crutch.

Among the main benefits of this product is the cushioning provided to the underarm area of the user. This cushioning reduces the pain and discomfort caused by the use of the crutch. Furthermore, the expandable and recoverable structure enables the product to be easily used and removed. Further, the pad surfaces are reversible which prolongs the useful life of the cover and also provides varying ornamental appearances when different colored fabrics are used for each face of the cover.

DETAILED DESCRIPTION OF THE INVENTION

Figure 1:
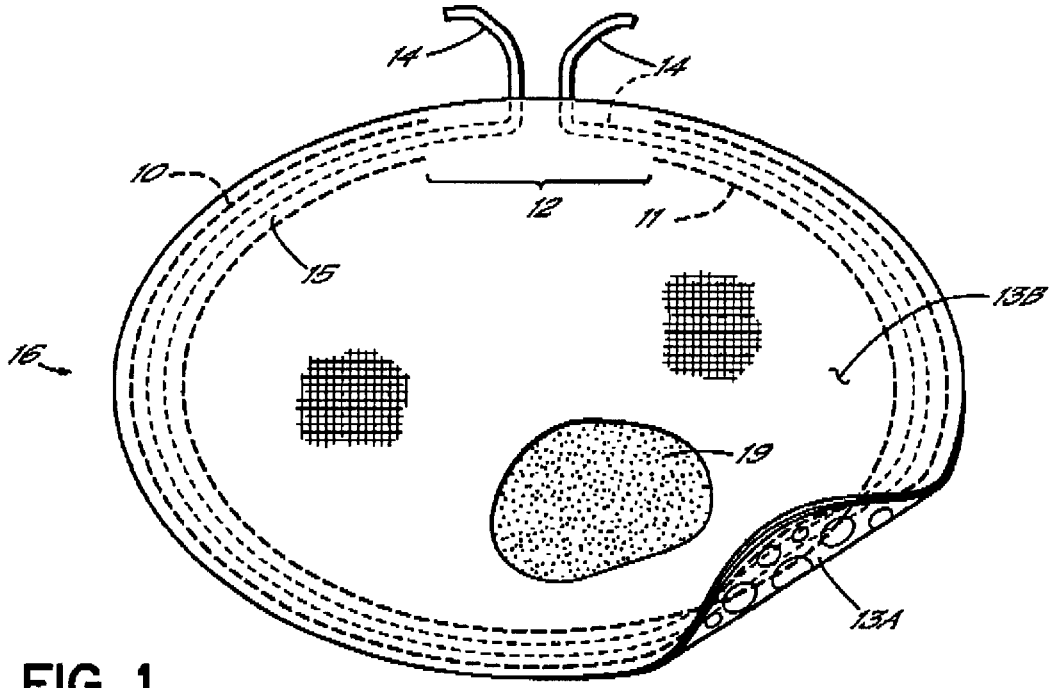
FIG. 1 is a schematic of the crutch underarm support pad prior to formation into its final shape revealing the various structural components of the underarm support pad.

The crutch pad cover is manufactured of a soft, flexible, washable sheet material, e.g. cotton, polyester and cotton-polyester (50/50 blend) fabric of a solid color or patterned print. From this material two roughly oval shapes 13*a*, 13*b* are cut. For the standard medical crutch, the long axis of each oval should be about 17 inches and the short axis should be about 11 inches. The ovals are juxtaposed so that the front sides of the material are facing one another and a ¼ inch seam 10 is stitched around the periphery, but leaving a 4 inch opening 12 between the starting and end points. This creates a pocket between the two ovals of material. This pocket is then turned inside out so as to conceal the seam at the periphery. An elastic material or nylon cord 14 is then placed into the pocket, via the 4 inch opening 12, and situated so that the cord or elastic is directly adjacent the seam on the inside of the pocket. The free ends of the elastic or cord 14 are left exposed at either side of the 4 inch opening. A ½ inch seam 11 is then stitched around the oval to the inside of the cord or elastic material 14. A 4 inch opening is left between the start and end points of the seam that corresponds to the ¼ inch seam 10 made earlier. This creates a channel 15 that holds the elastic or cord in position. The entire pocket is then filled with, as a cushioning material, e.g., 1 ounce of web spun polyester fiber fill 19. Other cushioning elements include polyester batting, cotton batting and foam rubber. The 4 inch opening 12 is then closed to a 12 inch opening leaving the ends of the elastic or cord 14 exposed.

Figure 2A:
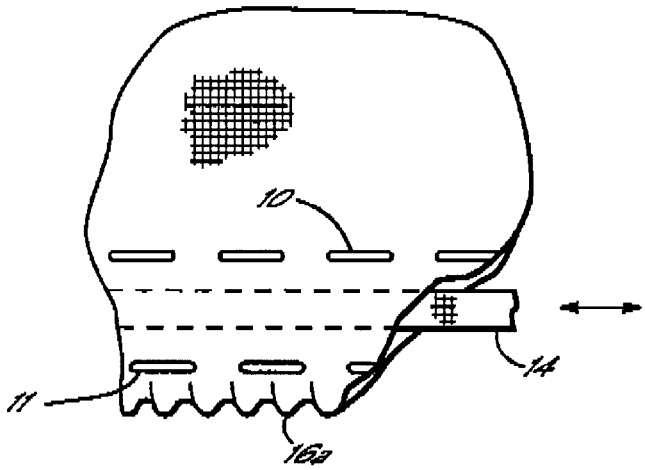
FIG. 2A is an enlarged view of encircled area 2 illustrating the expanding and recovering effect of an elastic band disposed within a channel along the peripheral edge of the underarm support pad.

The final shape of the pad is induced by drawing both ends of the elastic or cord in order to gather the peripheral edge 16*a* of the pad 16. In the case of elastic, the ends of the elastic are drawn so as to create a mushroom-like shape (See FIG. 2B) with a top outer surface 18 and a bottom inner surface 17 that forms a cavity to receive the underarm support of the crutch. Once this shape is attained, the ends of the elastic are then knotted or otherwise prevented from retracting. The cover can then be placed over the underarm support of the crutch 20 (See FIG. 3) and securely fastened through manipulation of the now expandable and recoverable peripheral edge 16*a* shown in FIG. 2A.

Figure 2C:
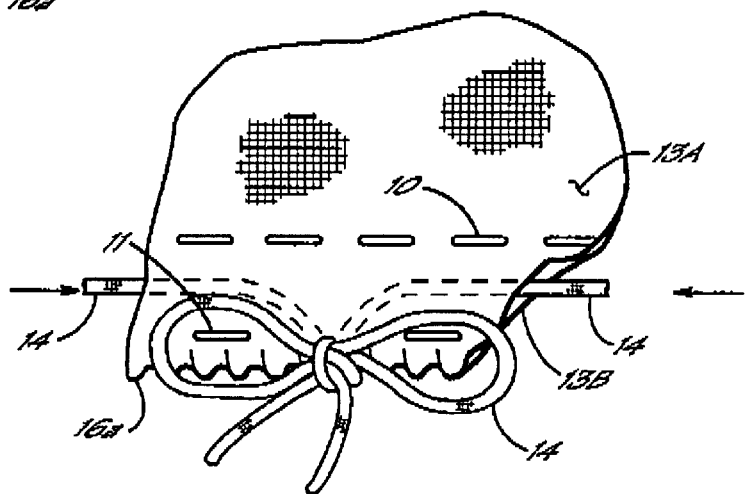
FIG. 2C is an enlarged view of encircled area 2 illustrating the expanding and recovering effect of a cord disposed within a channel along the peripheral edge of the underarm support pad.

When the nylon cord is used to secure the cover, the cover is placed on the underarm support of the crutch and the nylon cord drawn so as to gather the peripheral edge 16*a* of the cover 16 depicted in FIG. 2C. Once the nylon cord 14 has been gathered, the cover 16 is firmly attached to the crutch 20 and the nylon cord can be tied off so as to prevent the peripheral edge 16*a* of the cover from recovering its initial shape.

Figure 2B:
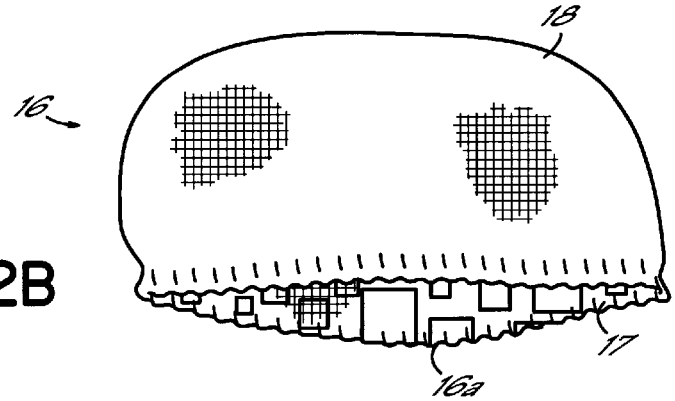
FIG. 2B illustrates the functional shape of the crutch underarm support pad and also the top and bottom faces of the pad which can be reversed.
Figure 3:
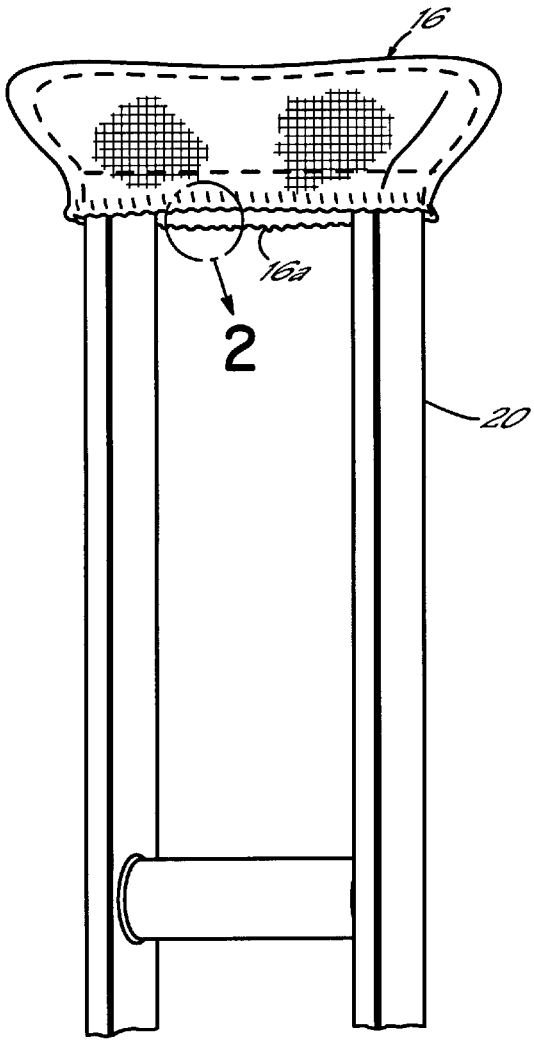
FIG. 3 illustrates the underarm support pad as it is positioned on the underarm support of a medical crutch.

The placement of the means of gathering of the peripheral edge, whether it be elastic or a cord, facilitates the reversibility of the cover. As shown in FIG. 2B, the underside 17 of the cover or the portion directly adjacent to the underarm support of the crutch can become the top or outside 18 of the cover simply by turning the cover inside-out. This does not effect the function of the expandable and recoverable peripheral edge.

Various modifications may be made to the above described protective covering and methods of making same as will be understood to a person of ordinary skill in the art in view of the above description.

What is claimed is:

1. A protective cover for the underarm support of a crutch comprising:

a cover of flexible sheet material providing an inner face, an outer face, and a peripheral edge, said peripheral edge being completely expandable and recoverable thereby allowing said cover to be securely fastenable and removable from the underarm support of said crutch and allowing the inner and outer faces of the cover to be reversed thereby becoming new outer and inner faces, respectively, and a cushioning element between said inner and outer faces to provide said underarm support.

2. The protective cover of claim 1 wherein the flexible sheet material is a fabric selected from the group consisting of cotton, polyester, and cotton-polyesters.

3. The protective cover of claim 1 wherein the flexible sheet material is a cotton-pOlyester fabric.

4. The protective cover of claim 1 wherein the flexible sheet material is a 50% cotton-50% polyester fabric.

5. The protective cover of claim 1 wherein the peripheral edge has an elongated element formed thereon selected from the group consisting of an elastic and a non-elastic material.

6. The protective cover of claim 5 wherein the sheet material is a fabric and the non-elastic element is a cord which is contained in a hem of said fabric on its peripheral edge so as to gather the peripheral edge of the fabric and thereby render the peripheral edge completely expandable and recoverable.

7. The protective cover of claim 5 wherein the elastic element is a band which is positioned on the peripheral edge of the flexible sheet material so as to directly gather the peripheral edge and thereby render the peripheral edge completely expandable and recoverable.

8. The protective cover of claim 1 wherein the cushioning element is selected from the group consisting of web spun polyester fibers, polyester batting, cotton batting, and foam rubber.

9. The protective cover of claim 8 wherein the cushioning element is an expandable and recoverable fibrous web.

10. A protective cover for the underarm support of a crutch comprising:

a cover of flexible sheet material providing an inner face, an outer face and a peripheral edge, said peripheral edge being completely expandable and recoverable thereby allowing said cover to be securely fastenable and removable from the underarm support of said crutch;

said completely expandable and recoverable peripheral edge permitting the inner and outer faces of said cover to be reversed thereby becoming new outer and inner faces, respectively;

about one ounce of a cushioning element disposed between said inner and outer faces.

11. The protective cover of claim 10 wherein the flexible sheet material is a fabric selected from the group consisting of cotton, polyester, and cotton-polyesters.

12. The protective cover of claim 10 wherein the flexible sheet material is a cotton-polyester fabric.

13. The protective cover of claim 10 wherein the flexible sheet material is a 50% cotton-50% polyester fabric.

14. The protective cover of claim 10 wherein the peripheral edge has an elongated element formed thereon selected from the group consisting of an elastic and a non-elastic material.

15. The protective cover of claim 14 the sheet material is a fabric and the non-elastic element is a cord which is contained in a hem of said fabric on the peripheral edge so as to gather the peripheral edge of the fabric and thereby render the peripheral edge completely expandable and recoverable.

16. The protective cover of claim 14 wherein the elastic element is a band which is positioned on the peripheral edge of the flexible sheet material so as to directly gather the peripheral edge and thereby render the peripheral edge completely expandable and recoverable.

17. The protective cover of claim 10 wherein the cushioning element is selected from the group consisting of web spun polyester fibers, polyester batting, cotton batting, and foam rubber.

18. The protective cover of claim 17 wherein the cushioning element is an expandable and recoverable fibrous web.

19. A method for making a cover for the underarm support of a crutch, comprising the steps of:

providing first and second sheets of a flexible material, each having a front face and a back face;

juxtaposing the front sides of said first and second sheets together such that a peripheral edge and inner and outer faces are formed;

coupling first and second sheets of said flexible material along the peripheral edge to form a pocket there between;

providing an elongated element along the peripheral edge of the pocket wherein the element is either collectable or elastic, thereby rendering the entire peripheral edge completely expandable and recoverable;

providing about one ounce of a cushioning element between the inner and outer faces, and coupling the opposing faces of the pocket leaving the elongated element capable of manipulation so as to render the peripheral edge completely expandable and recoverable.

20. The protective cover of claim 19 wherein the flexible sheet material is a fabric selected from the group consisting of cotton, polyester, and cotton-polyesters.

21. The protective cover of claim 19 wherein the flexible sheet material is a cotton-polyester fabric.

22. The protective cover of claim 19 wherein the flexible sheet material is a 50% cotton-50% polyester fabric.

23. The protective cover of claim 19 wherein the peripheral edge has an elongated element formed thereon selected from the group consisting of an elastic and a non-elastic material.

24. The protective cover of claim 23 wherein the sheet material is a fabric and the non-elastic element is a cord which is contained in a hem of said fabric on the peripheral edge so as to gather the peripheral edge and thereby render the entire peripheral edge completely expandable and recoverable.

25. The protective cover of claim 23 wherein the elastic element is a band positioned on the peripheral edge of the flexible sheet material so as to directly gather the peripheral edge and thereby render the peripheral edge completely expandable and recoverable.

26. The protective cover of claim 19 Wherein the cushioning material is selected from the group consisting of web spun polyester fibers, polyester batting, cotton batting, and foam rubber.

27. The protective cover of claim 26 wherein the cushioning element is an expandable and recoverable fibrous web.

* * * * *

UNITED STATES PATENT AND TRADEMARK OFFICE

CERTIFICATE OF CORRECTION

PATENT NO. : 6,718,994 B2
DATED : April 13, 2004
INVENTOR(S) : Lewis

It is certified that error appears in the above-identified patent and that said Letters Patent is hereby corrected as shown below:

Column 3,
Line 20, "closed to a 12 inch opening." should be -- closed to a ½ inch opening --

Column 4,
Line 5, "cotton-pOlyester" should be -- cotton-polyester --
Line 53, "The protective cover of claim 14 the sheet material is…" should be -- The protective cover of claim 14 wherein the sheet material is… --

Column 6,
Line 19, "cover of claim 19 Wherein the…" should be -- cover of claim 19 wherein the … --

Signed and Sealed this

Sixth Day of July, 2004

JON W. DUDAS
*Acting Director of the United States Patent and Trademark Office*